US006554279B1

(12) United States Patent
Vanderhye

(10) Patent No.: US 6,554,279 B1
(45) Date of Patent: Apr. 29, 2003

(54) SECRET DEMISE

(76) Inventor: Russell Vanderhye, 9352 Twin Trails Dr., Apt. 102, San Diego, CA (US) 92129

( * ) Notice: Subject to any disclaimer, the term of this patent is extended or adjusted under 35 U.S.C. 154(b) by 74 days.

(21) Appl. No.: 09/590,301

(22) Filed: Jun. 9, 2000

(51) Int. Cl.[7] ..... A63F 3/00
(52) U.S. Cl. ..... 273/236; 273/292; 273/248
(58) Field of Search ..... 273/236, 292, 273/248, 243, 249, 134, 135, 284

(56) References Cited

U.S. PATENT DOCUMENTS

| | | | | | |
|---|---|---|---|---|---|
| 2,317,705 | A | * | 4/1943 | Wood | 273/137 |
| 3,042,408 | A | * | 7/1962 | Johnson | 273/135 |
| 3,841,628 | A | * | 10/1974 | Goldfarb | 273/1 R |
| 3,850,434 | A | * | 11/1974 | Ockenfels | 273/135 AC |
| 4,061,337 | A | * | 12/1977 | Callender | 273/134 AT |
| 4,315,627 | A | * | 2/1982 | Schlegel | 273/249 |
| 4,883,277 | A | * | 11/1989 | Laisure | 273/236 |
| 5,020,805 | A | * | 6/1991 | Fratangelo et al. | 273/255 |
| 5,033,752 | A | * | 7/1991 | Bunting | 273/251 |
| 5,118,113 | A | * | 6/1992 | Ahlers et al. | 273/243 |
| 5,350,179 | A | * | 9/1994 | Hill et al. | 273/249 |
| 5,351,955 | A | * | 10/1994 | Danby | 273/141 R |
| 5,407,204 | A | * | 4/1995 | Meyer, III | 273/244 |
| 5,476,264 | A | * | 12/1995 | Ortega | 273/255 |
| 5,556,100 | A | * | 9/1996 | Taylor et al. | 273/249 |
| 5,566,945 | A | * | 10/1996 | Saguccio | 273/284 |
| 5,607,159 | A | * | 3/1997 | Bryson | 273/243 |
| 5,618,043 | A | * | 4/1997 | McGlew | 273/308 |
| 5,657,992 | A | * | 8/1997 | Bellizzi | 273/273 |
| 5,676,369 | A | * | 10/1997 | DeWeese | 273/249 |
| 5,749,582 | A | * | 5/1998 | Fritz et al. | 273/246 |
| 5,772,213 | A | * | 6/1998 | McGlew | 273/308 |
| 5,853,173 | A | * | 12/1998 | Murphy | 273/246 |
| 5,927,717 | A | * | 7/1999 | Berkovi et al. | 273/271 |
| 5,941,525 | A | * | 8/1999 | Gallub | 273/248 |
| 6,139,016 | A | * | 10/2000 | Plato | 273/242 |
| 6,299,169 | B1 | * | 10/2001 | Adams et al. | 273/248 |

* cited by examiner

*Primary Examiner*—Benjamin H. Layno
*Assistant Examiner*—Dolores Collins

(57) ABSTRACT

A game and method of playing the game utilize a player in a master role with the other players in subservient roles, with the master role player trying to eliminate the subservient players in a particular order of succession, while the subservient players attempt to locate the secret demise location of the master player on a game board grid. Desirably the player pieces are unique and have the image of a human being, including unique head features, and character cards are utilized having indicia corresponding to the unique head features of the playing pieces. A plurality of action cards at least the same in number as the number of unique playing pieces are also provided, each action card having an indicia side having first indicia corresponding to at least one, but not all, of the unique playing pieces so that at least one of the action cards has indicia corresponding to each of the unique playing pieces. One or a plurality of information cards or sheets have indicia defining an order of succession for each of the unique playing pieces and relating the action card first indicia to the unique playing pieces.

21 Claims, 10 Drawing Sheets

SECRET DEMISE

BACKGROUND AND SUMMARY OF THE INVENTION

Many board games base their entertainment value and utilization on generating a random number or by chance selecting a mode of movement, so that a playing piece moves along a predetermined path on a game board. Other games, such as Battle Ships, use a grid without moving pieces. The invention provides a game which utilizes a board which has elements of both of the types of games described above, with a number of unique features that enhance the enjoyment and strategy associated with the game, allowing individual players to have the maximum level of freedom to either succeed or fail in the game's objectives.

The board game according to the present invention will be described with respect to a game which simulates the well known poem "Ten Little Indians", and relates to the demise of individual playing pieces by a "death" pretense. However it is to be understood that this description is exemplary only, and the game may be played having an almost infinite variety of formats, and that the demise pretense of individually eliminated pieces or players can have any pretense besides death, such as bankruptcy, "on vacation", "back to work", "on to another life", or any other "out of game" pretense.

According to one aspect of the present invention there is provided a game comprising: A plurality of different, unique, playing pieces. A board having a playing surface with a grid defined thereon, the grid defining a plurality of grid squares, the plurality of grid squares comprising at least about ten times the number of unique playing pieces. The playing pieces having a base dimensioned to substantially fit on a grid square. A map comprising a substantially accurate reproduction of the board playing surface only having dimensions significantly less than (e.g. less than half of) the playing surface dimensions. A plurality of action cards [e.g. comprising at least the same number as the plurality of unique playing pieces], each action card having a substantially common generic side, and an indicia side having first indicia thereon corresponding to at least one, but not all, of the unique playing pieces, so that at least one of the action cards has indicia thereon corresponding to each of the unique playing pieces. And, one or a plurality of information cards or sheets having indicia thereon defining an order of succession for each of the unique playing pieces and relating the action card first indicia to the unique playing pieces.

The game may further comprise a plurality of character cards, each character card having unique variable second indicia thereon corresponding to one of the unique playing pieces, so a character card with unique second indicia is provided for each of the unique playing pieces. For example the unique playing pieces each have an image of a human being, including unique head features; and the character cards have, as at least part of the second unique variable indicia thereof, substantially the unique head features of the corresponding unique playing piece.

In the preferred embodiment the one or a plurality of information cards or sheets comprises a plurality of information cards, including one having unique third indicia, including unique succession indicia, for each of the unique playing pieces. For example each of the information cards includes thereon further indicia corresponding to a plurality, but not all, of the action cards. As a further example the first indicia and the further indicia both comprise a form of demise of at least one of the unique playing pieces, and at least two of the action and information cards have common demise indicia thereon for at least two of the unique playing pieces.

The game may further comprise a plurality of generic playing pieces, one corresponding to each of the unique playing pieces, for example the generic playing pieces may simulate American Indians (Native Americans). The number of grid squares is preferably at least about twenty times the number of the unique playing pieces, e.g. about 46 times. Preferably also the board has pictorial indicia overlying at least some of the grid squares. It is to be understood that the term "square" as used in the present application is intended to mean a particular location in a grid, and not necessarily a truly square shape. The plurality of unique game pieces may be either ten or eleven in number in the particular embodiment described herein, but can be other numbers in games with other themes.

According to another aspect of the present invention a game is provided comprising: A plurality of different, unique, playing pieces. A board having a playing surface with a grid defined thereon, the grid defining a plurality of grid squares, the plurality of grid squares greater in number than the number of unique playing pieces. The playing pieces having a base dimensioned to substantially fit on a grid square. A plurality of action cards [e.g. comprising at least the same number as said plurality of unique playing pieces], each action card having a substantially common generic side, and an indicia side having first indicia thereon corresponding to at least one, but not all, of the unique playing pieces, so that at least one of the action cards has indicia thereon corresponding to each of the unique playing pieces. And, a plurality of character cards, each character card having unique variable second indicia thereon corresponding to one of the unique playing pieces, so a character card with unique second indicia is provided for each of the unique playing pieces. The game according to this aspect of the invention may also have the other features as described above.

According to another aspect of the present invention there is provided a method of playing a board game using a board having a playing surface with a grid defined thereon defining a plurality of grid squares greater in number than the number of unique playing pieces; and a plurality of unique playing pieces having a base dimensioned to substantially fit on a grid square, a map comprising a substantially accurate reproduction of the board playing surface only having dimensions less than that of the playing surface dimensions, and a plurality of action cards, comprising: a) Determining which of a plurality of players has which unique playing piece. b) Determining which player will have a master role, with all other players having subservient roles. c) Using the map, the player with the master role secretly indicating on the map a unique demise location of each of the subservient role players, as well as the master role player. d) Establishing an order of movement of playing pieces in each of the turns corresponding to a specific order of succession of the unique playing pieces, and the master role player going last. e) Each subservient player moving his or her unique playing piece on the game board grid playing surface during his or her turn to attempt to find a grid square corresponding to the secret map location of another subservient player (e.g. higher in the succession order), or the secret map location of the master role player. f) The master role player, during his or her turn, moving to the board grid square corresponding to the subservient player first, or next, in the order of succession, and then selecting an action card. g) If the action card selected in f) corresponds to a predetermined manner of demise of the subservient player effectively removing the respective subservient player's unique playing piece from the game board, and if the action card does not so correspond, the master role player continuing selection of an action card during each of his or her turns until an action card is selected corresponding to the predetermined manner of demise. And, h) declaring an end of the game if a subservient player moves his or her playing piece to the grid square on the game board corresponding to the secret demise location of the master player, or when the master player effectively removes all, or all but one, subservient player pieces from the game board pursuant to f) and g) in the proper order of succession.

In the method as described above a) may be practiced by having each player draw a character card, each character card having unique indicia thereon corresponding to a unique playing piece. Also generic playing pieces may be provided (for example simulating American Indians) which are placed in a particular location on the game board, and removed whenever a particular subservient role player is eliminated. In playing the game according to the invention, the rules may also include allowing a subservient player, during his turn, to ask the master role player to give the subservient role player a clue, or to honestly answer a question of the subservient role player, which can help identify where the secret unique demise location of another subservient player is (e.g. a subservient role player higher in the succession order) so that the first subservient role player can put himself or herself in place of the higher up subservient role player, or which will help identify the secret location of the master role player.

It is the primary object of the present invention to provide a unique and entertaining board game and method of playing the same. This and other objects of the invention will become clear from an inspection of the detailed description of the invention and from the appended claims.

DETAILED DESCRIPTION OF THE DRAWINGS

Figure 1:
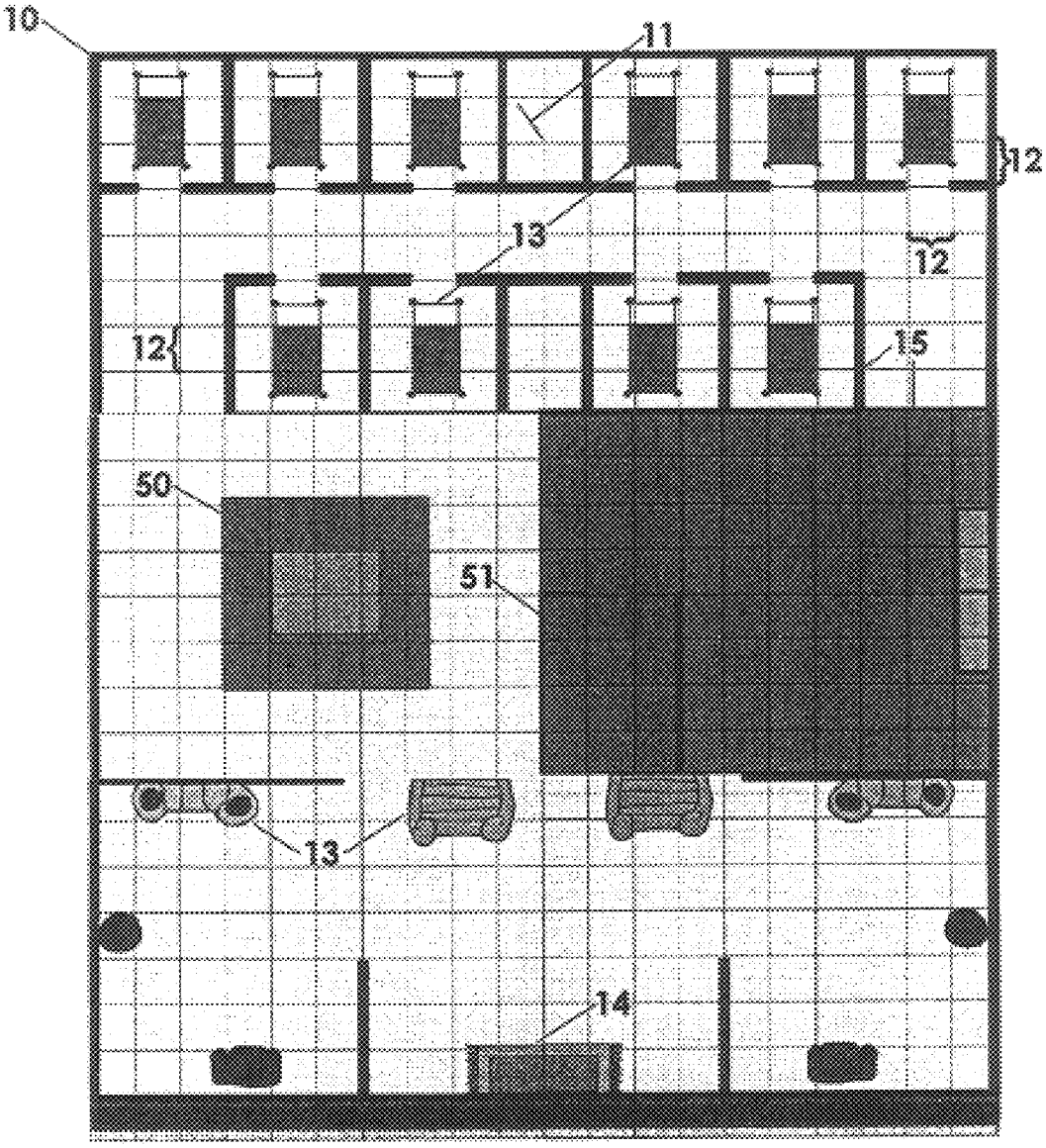
FIG. 1 is a top plan view of the exemplary game board according to the present invention.

FIG. 1 schematically illustrates an exemplary game board 10 that may be utilized according to the present invention. The board 10 is shown generally by reference numeral 11 with a grid defining a plurality of grid squares 12. The term "grid squares" does not necessarily refer to shape but merely to the element of a grid, which could have other shapes, such as triangular, trapezoidal, or the like. While not shown in FIG. 1, the grid rows and columns may be labeled (e.g. with letters and/or numbers). The number of grid squares 12 is preferably at least about ten times the number of playing pieces, preferably at least about twenty times and in the illustrated embodiment approximately 46 times the number of playing pieces. As also seen in FIG. 1, the board 10 may have pictorial indicia overlying at least a plurality of the grid squares, such as the simulations of furniture 13, floor coverings 14, or rooms 15, illustrated in FIG. 1. Other pictorial indicia may also be provided.

Figure 2:
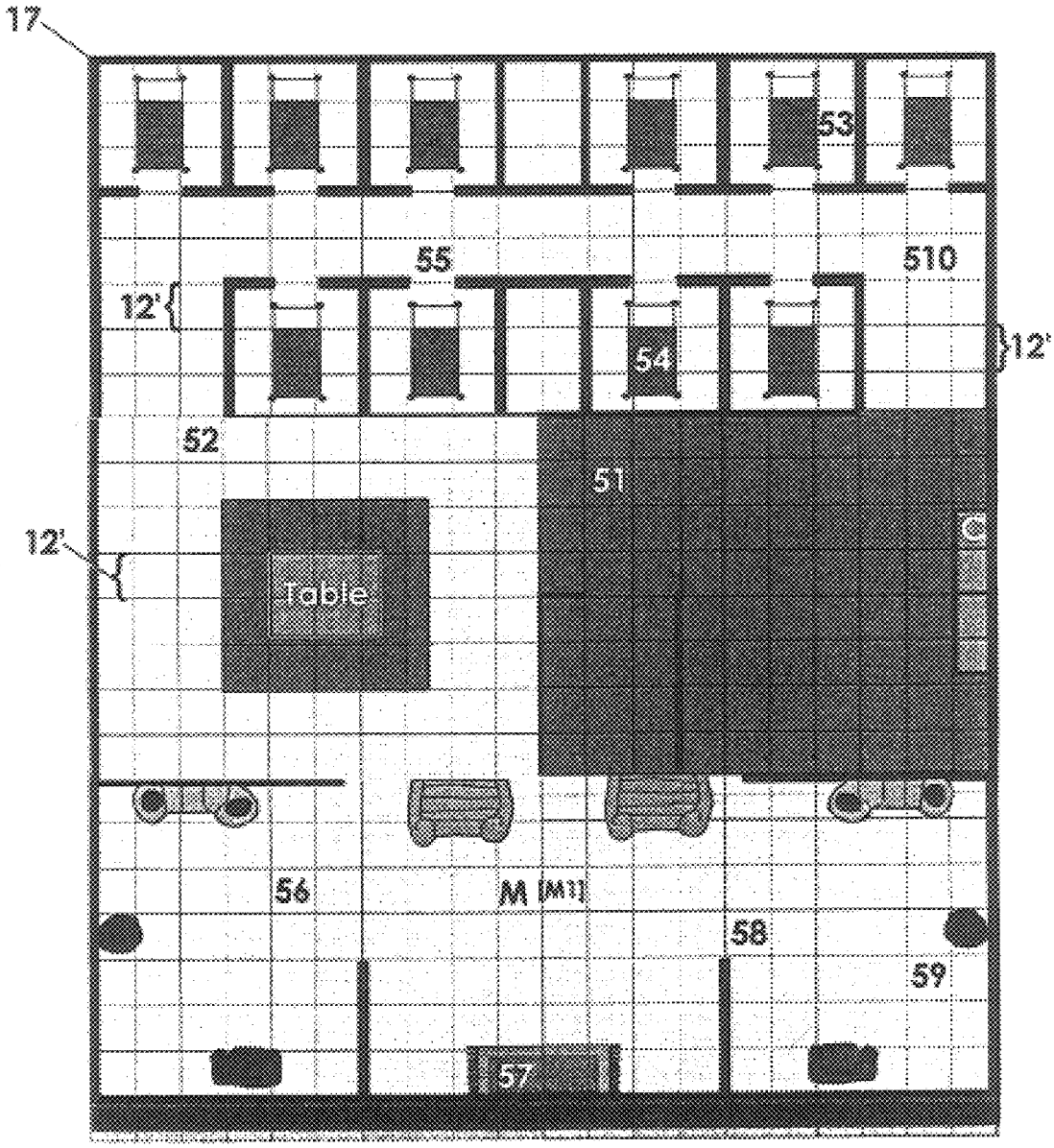
FIG. 2 is a top plan view of a map of the game according to the present invention and indicating thereon the secret demise locations of subservient role and the master role players according to the present invention.

FIG. 2 illustrates a map 17 which comprises a substantially accurate reproduction of the board 10 but having significantly smaller dimensions, e.g. less than about half of the playing surface 11 dimensions. For example the dimensions of the map 17 may be one quarter to one sixth those of the board 10 playing surface 11. While it is preferred that the map 17 be a completely accurate reproduction of the board 10, various features can be shown in lesser detail or more schematically on the map 17 than on the board 10 playing surface 11. However the map 17 must have grids 12' corresponding in number and general position to those at the grids 12 in FIG. 1. The map 17 may be of paper, or a plastic that is readily erasable, or the like.

Figure 3:
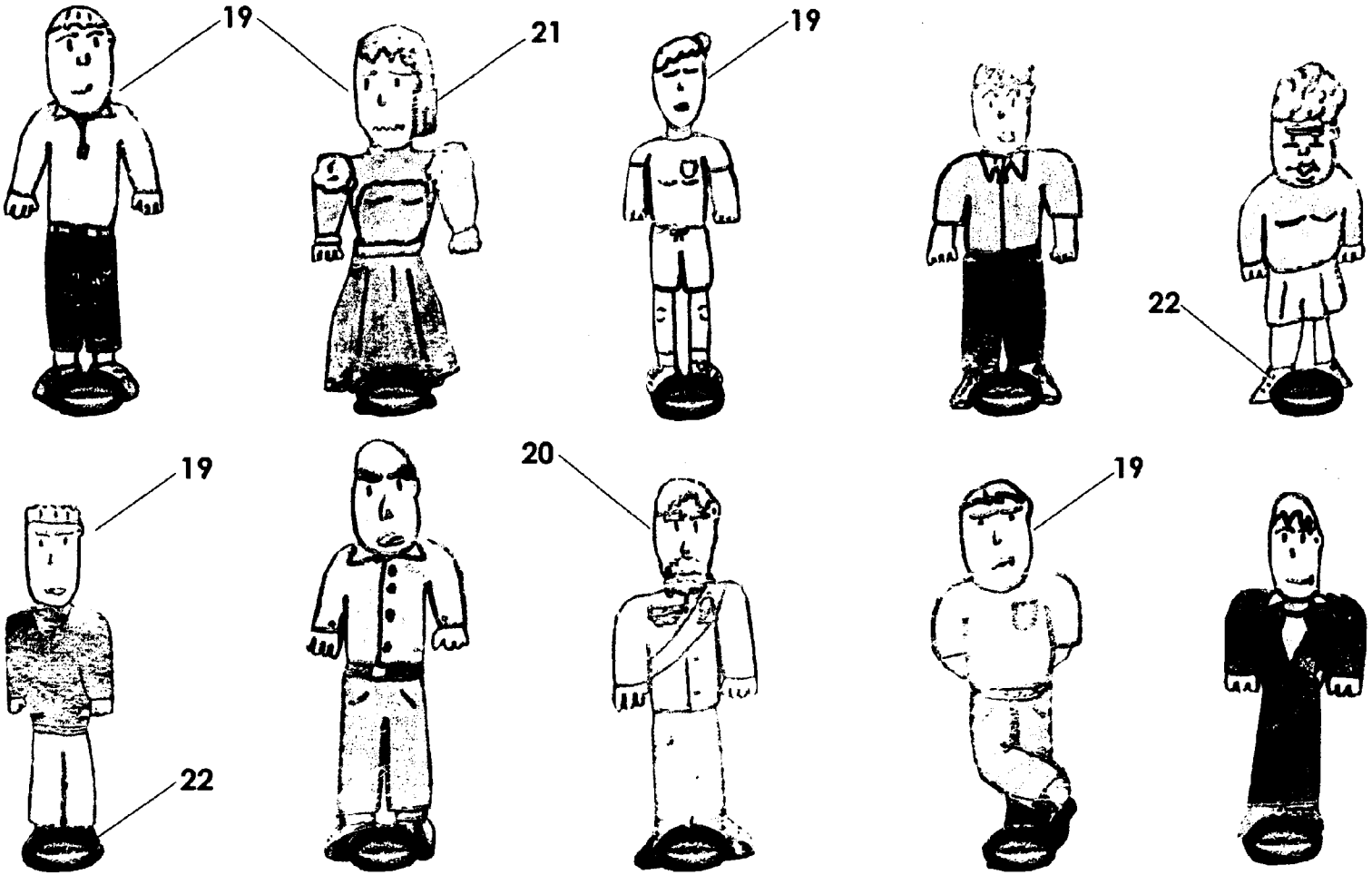
FIGS. 3 and 4 are front and rear views, respectively, of exemplary unique playing pieces according to the invention.
Figure 4:
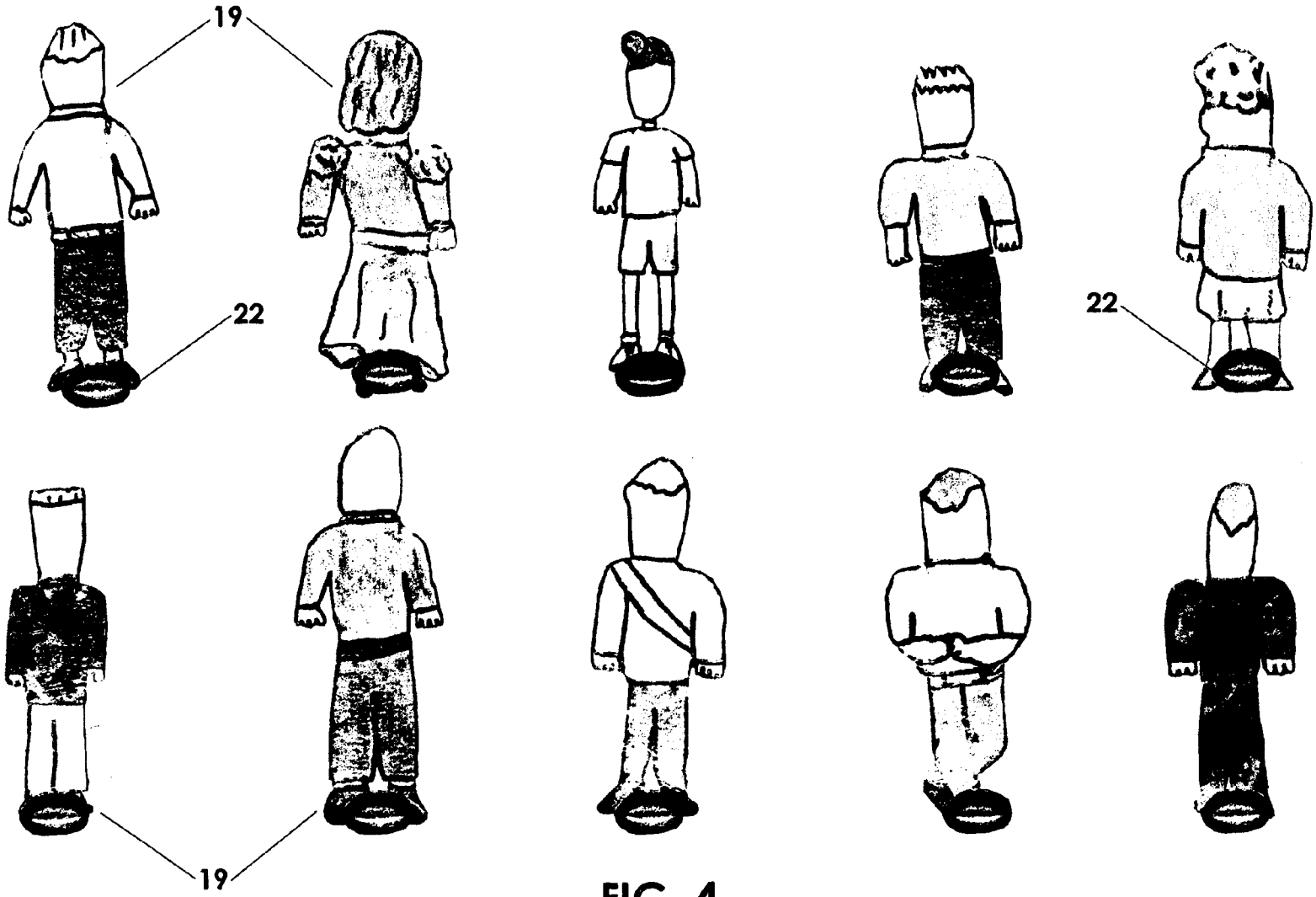

FIGS. 3 and 4 show the front and rear views of unique playing pieces that are preferably provided according to the invention. In the preferred embodiment of the invention ten or eleven unique playing pieces, shown generally by reference numeral 19, in FIGS. 3 and 4 are provided. Preferably the unique playing pieces 19, seen in FIGS. 3 and 4, have an image of a human being, including head features, such as the exemplary unique head features 20 and 21 illustrated for just two of the game pieces 19 in FIG. 3. Each playing piece 19 preferably also has a base 22 which is dimensioned so that it can substantially fit within a grid square 12 of the game board 10.

Figure 5:
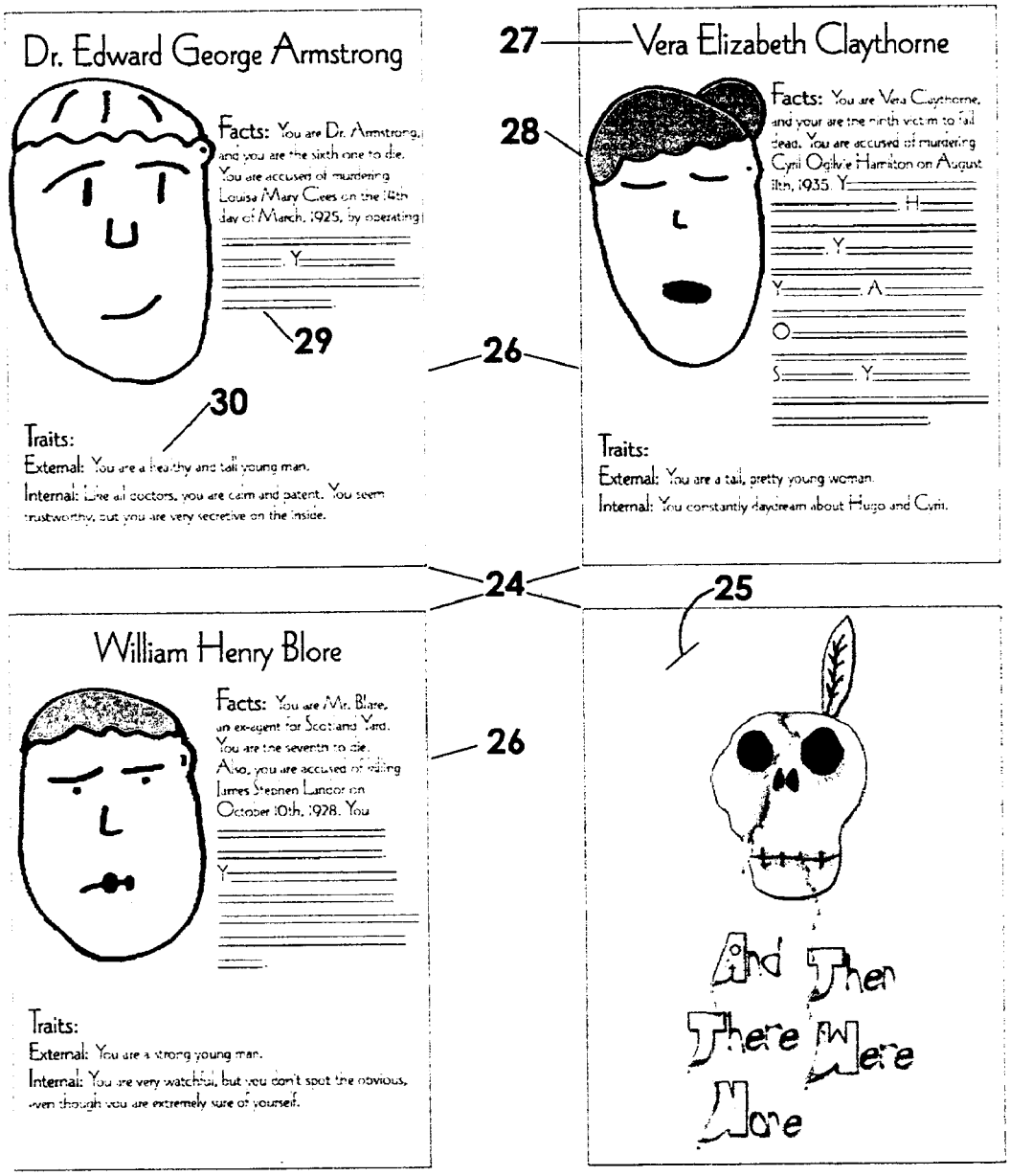
FIGS. 5 through 7 are schematic illustrations of character cards that may be utilized according to the present invention.
Figure 6:
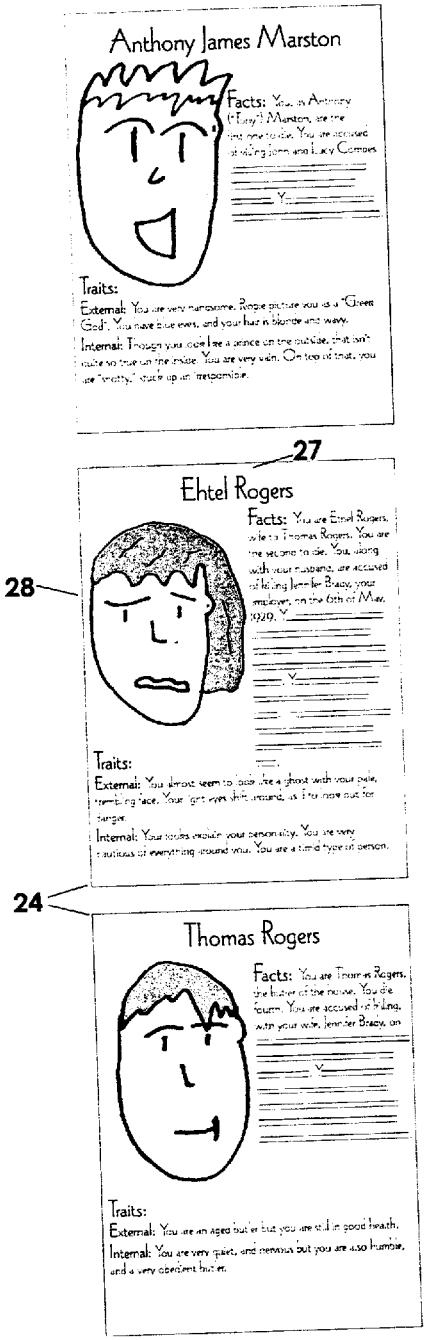
Figure 7:
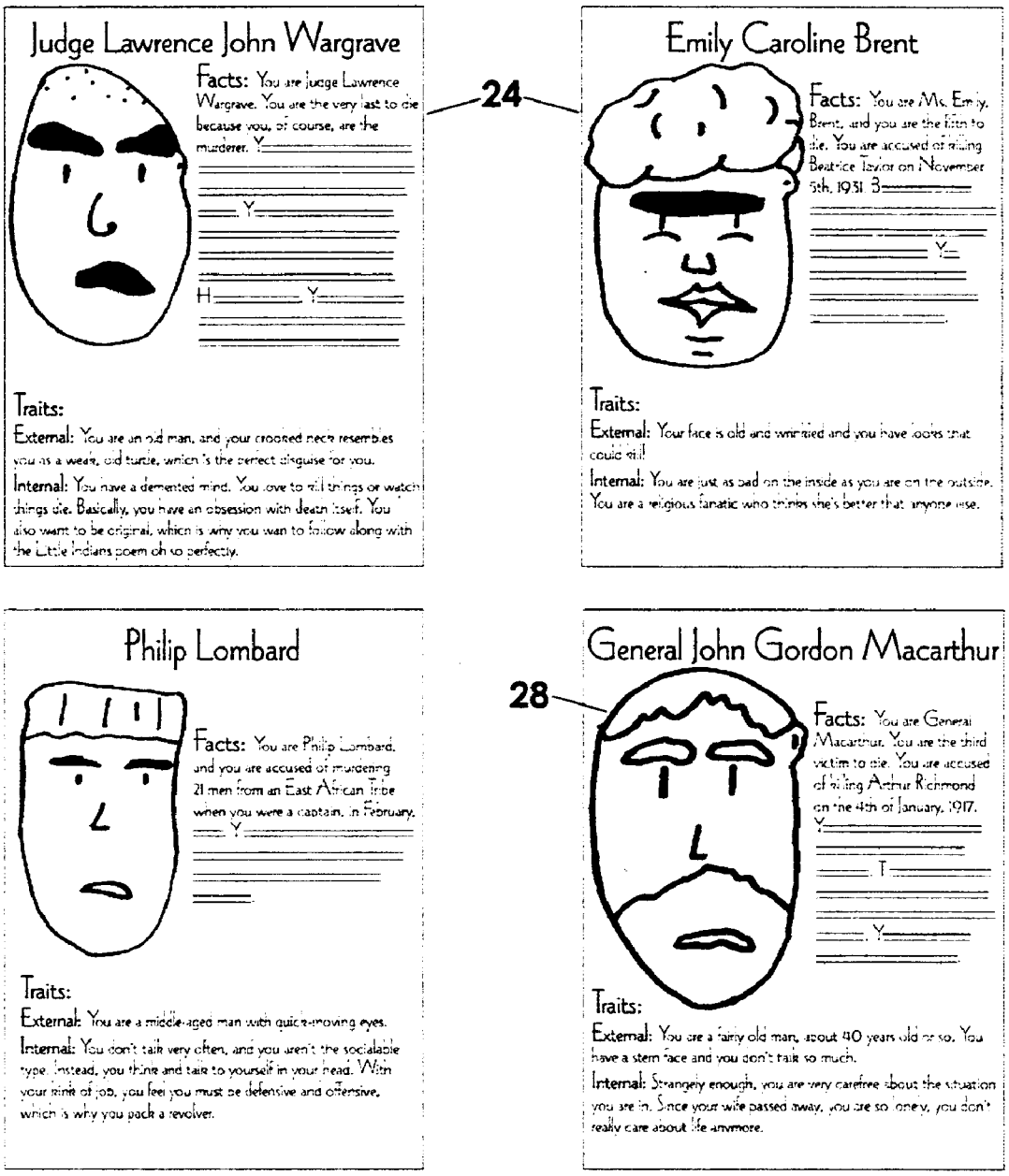

The game also preferably comprises a plurality of unique character cards, shown generally by reference numeral 24 in FIGS. 5 through 7. Each character card 24 has a generic face 25, seen in FIG. 5, and a unique indicia containing face 26 having unique second indicia thereon. The unique second indicia may take the form of a name 27 of a character, as well as card unique head indicia 28 of the character, for example card unique indicia 28 for the character Ethel Rogers illustrated in FIG. 6 corresponding to the unique head indicia 21 of one of the playing pieces 19 of FIG. 3, and the card unique head indicia 28 of the character General John Gordon McArthur illustrated in FIG. 7 corresponding to unique head indicia 20 of one of the playing pieces 19 in FIG. 3. The character cards of FIGS. 5 through 7 may also have additional indicia thereon, such as fact indicia 29 and trait indicia 30, that may be utilized simply for amusement, education, or depending upon the rules of the game may provide information that is in some way use to be assist in locating other players' secret demise locations or the like, or another aspect that will enhance the enjoyment and versatility of the game.

Figure 9:
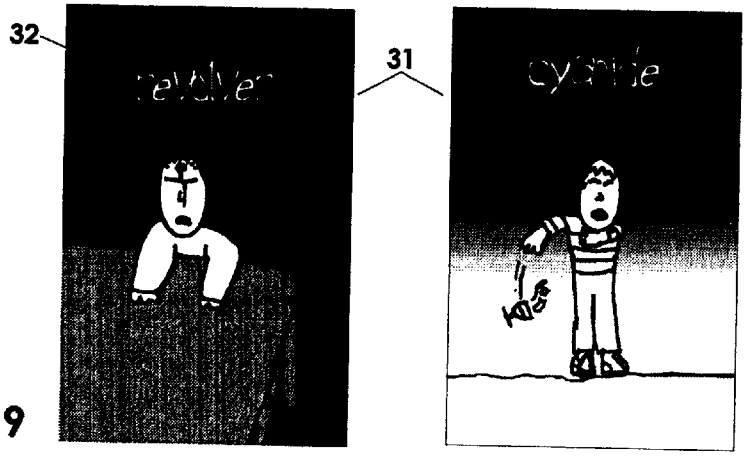
FIGS. 8 and 9 are schematic illustrations of exemplary action cards that may be utilized according to the present invention.
Figure 8:
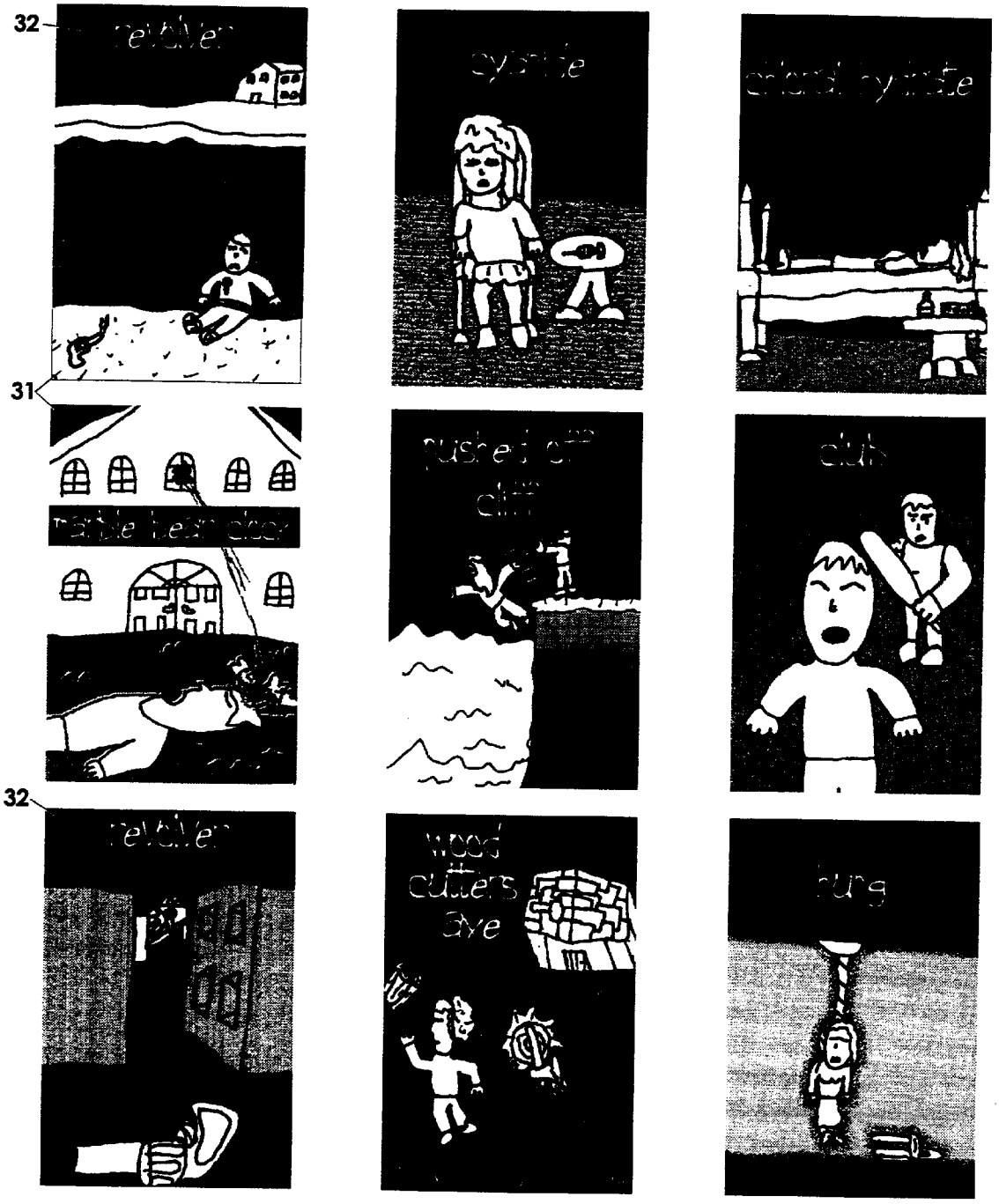

The game also includes a plurality of action cards illustrated generally by reference 31 in FIGS. 8 and 9. Each of the action cards 31 has a first generic side 25 illustrated in FIG. 5, and an indicia side. The indicia sides are illustrated in FIGS. 8 and 9 and have first indicia thereon corresponding to at least one, but preferably not all, of the unique playing pieces 19 so that at least one of the action cards 31 has indicia thereon corresponding to each of the unique playing pieces 19. In the embodiment illustrated in FIGS. 8 and 9 the action cards 31 have a form of demise that has the first indicia, the form of demise for at least one of the unique playing pieces 19. Typically at least two of the action cards have common demise indicia thereon for at least two of the unique playing pieces 19. For example the upper and lower left cards in FIG. 8 both have first indicia calling for a "revolver", indicated schematically at 32, while other action cards 31 can have a demise indicia that is unique to one action card, or they may also be repeated on other cards.

Typically, but not necessarily, the cards 24 are larger than the cards 31.

Figure 10:
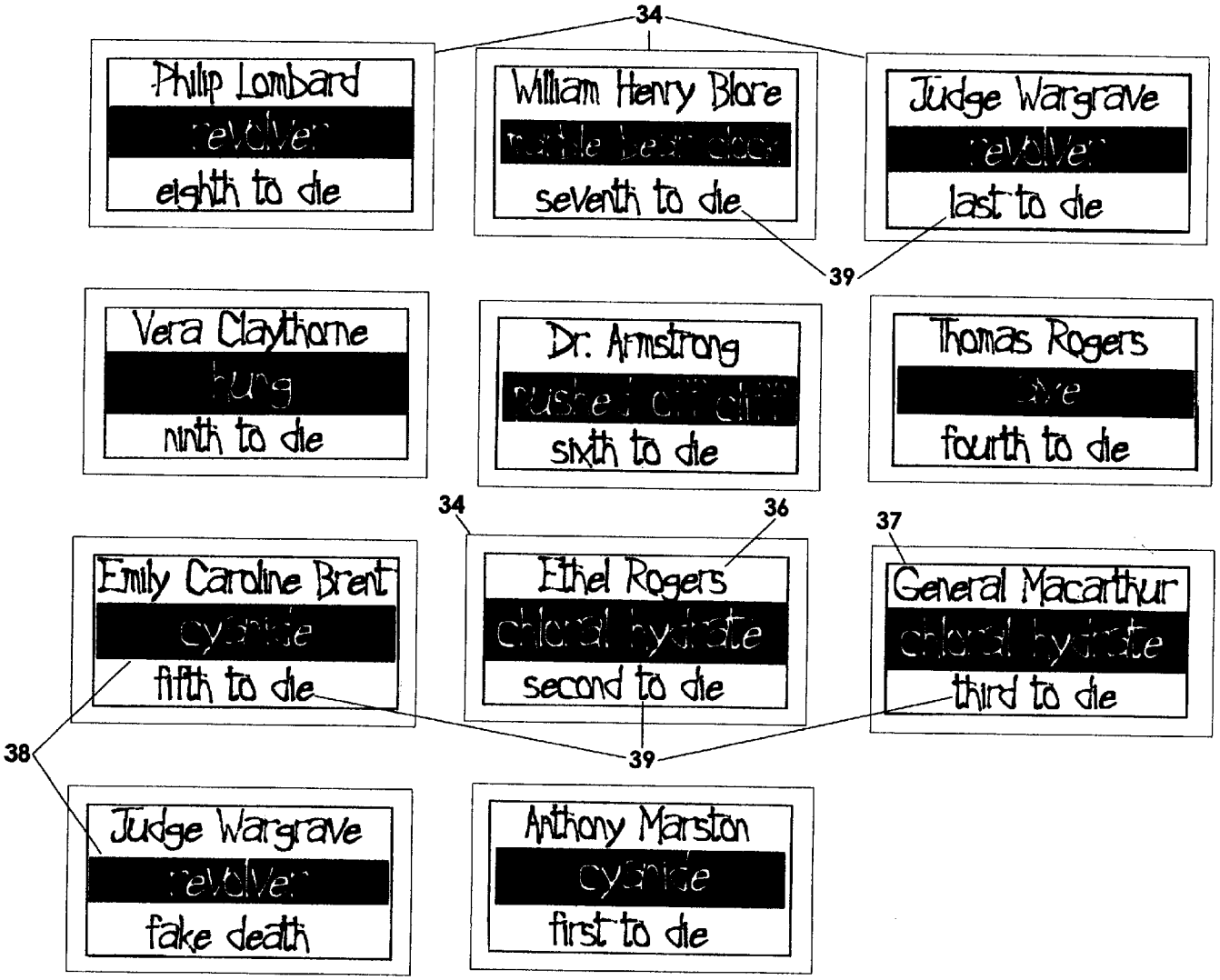
FIG. 10 comprises a schematic illustration of exemplary information cards according to the present invention.

FIG. 10 also indicates a plurality of information cards 34 that may be utilized in playing the game according to the present invention. Instead of the information cards 34, a single printed card or sheet may be provided having the information that is provided on the information cards 34. The information on the cards 34 includes name indicia, the name indicia corresponding to a unique character card 24 name indicia 27 and unique game piece 19. For example the name Ethel Rogers 36 on one of the information cards 34 corresponds to the name 27 "Ethel Rogers" on one of the character cards of FIG. 6, and to the unique head features 21 of one of the playing pieces 19, while the name indicia 37 corresponds to that of another character card 24, of FIG. 7, and to the head features 20 of one of the pieces 19 in FIG. 3.

The information cards 34 also include a manner of demise 38 associated with each of the individuals 36, 37, etc. which is also provided on one or more of the action cards 31 of FIGS. 8 and 9.

The information cards 34 also provide an order of succession for each of the unique playing pieces 19, and relate the action first indicia to the unique playing pieces 19. The order of succession may be for any particular pretense, such as which of the characters is the first, second, third, etc. to "die", "go bankrupt", or otherwise be eliminated (temporarily or permanently) from the game. The succession indicia is indicated at 39 for the information cards 34 in FIG. 10. When the information provided on the individual cards 34 is in card form, the cards 34 may be turned over as each player meets her or his demise.

Figure 11:
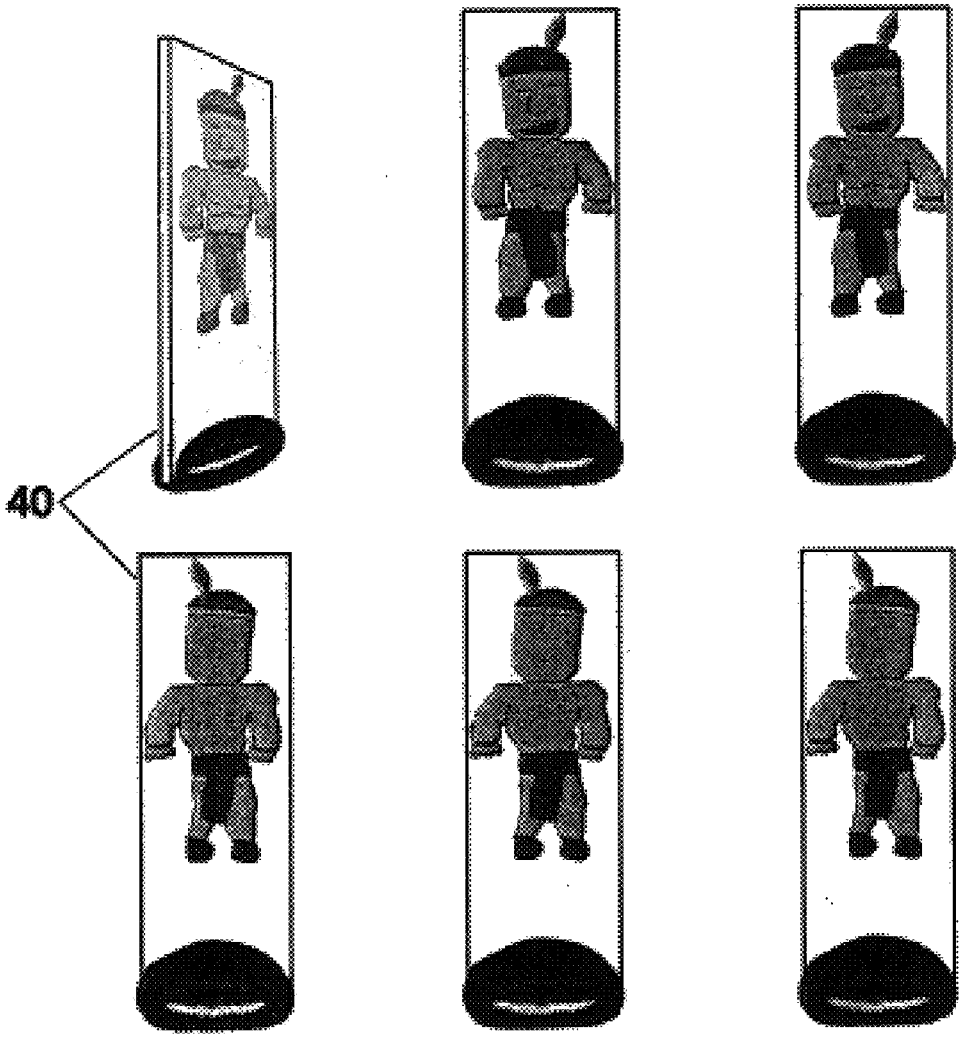
FIG. 11 comprises front and rear schematic illustrations of a plurality of generic playing pieces that may utilized according to the present invention.

FIG. 11 illustrates other optional game pieces 40 that may be utilized according to the present invention. The generic game pieces 40 in the embodiment illustrated in FIG. 11 simulate American Indians (in shape, or for the embodiment actually illustrated in FIG. 11, merely printed on a rectangular cardboard piece). All of the generic pieces 40 preferably are substantially the same.

The method of playing the board game 10 illustrated in FIGS. 1 through 11 may be as follows:

(a) Determine which of a plurality of players has which unique playing piece 19. For example this may be accomplished by the players drawing the cards 24 from a deck (with the generic side 25 up), each player then selecting the unique playing piece 19 corresponding to the unique indicia 27, 28 on the particular card 24 drawn.

The method also comprises (b) determining which player has a master role, while all other players have subservient roles. The master role is, in the embodiment described above, that of the "Judge", who has as a mission to eliminate all of the other players in the game, while all of the subservient players have the goal of eliminating the judge (or being the last subservient player to meet his or her demise, depending on the rules).

The method further comprises (c) using the map 17, the player with the master role secretly indicating on the map a unique demise location of each of the subservient role players, as well as of the master role player himself or herself. For example in FIG. 2 various of the grid squares are labeled 52–510, which corresponds to the secret (except to the master role player) demise location of each of the subservient role players, while the master role player's secret demise location is indicated by M. Depending upon the game rules the master role player's demise location may be required to be more than one grid square 12' (corresponding to grid squares 12 on the playing surface 11), such as schematically illustrated by bracketed designation M1 in FIG. 2.

The method also comprises (d) establishing an order of movement of playing pieces in each of the turns corresponding to a specific order of succession of the unique playing pieces 19, and the master role player going last. The order of succession is provided by—in the embodiment illustrated in the drawings—the order that each of the players "dies", as indicated by the indicia 39 in FIG. 10.

The method further comprises (e) each subservient player moving his or her unique playing piece 19 on the game board 10 grid playing surface 11 during his or her turn to attempt to find a grid square 12 corresponding to the secret map location (S1–S10) of another subservient player higher in the succession order, or the secret map location (M, M1) of the master role player. Depending on the rules the playing pieces 19 can eliminate any other player whose demise location they land on, whether or not higher in the succession order.

The method also comprises (f) the master role player, during his or her turn, moving her or his piece 19 to the board grid square 12 corresponding to the subservient player first (S1 in FIG. 2), or next, in order of succession, and then selecting an action card 31. Then if the action card 31 selected in f) corresponds to a predetermined manner of demise of the subservient player, the master player effectively removing the respective subservient player's unique playing piece from the game board, and if the action card does not so correspond, the master role player continues selection of an action card 31 during each of his or her turns until an action card 31 is selected corresponding to the predetermined manner of demise. For example if the first player in the order of succession, Anthony Marston, the first to die in the order of succession, is to die by cyanide, and a card 31 selected has cyanide thereon, then the playing piece 19 corresponding to Anthony Marston is effectively removed from the playing surface 11 (either actually removed, or removed even though not physically removed; e.g. the applicable card 34 can be turned over instead and the piece 19 left on the board 10). However if a card 31 with "revolver" indicia 32 is selected, then the master role player must wait until his or her next turn and draw another card 31, until a or the card 31 having the "cyanide" indicia is drawn.

The method also preferably comprises (h) declaring an end of the game if a subservient player moves his or her playing piece to the grid square on the game board corresponding to the secret demise location of the master player (M in FIG. 2), or when the master player effectively removes all (or all but one) subservient player pieces 19 from the game board pursuant to f) and g) in the proper order of succession.

Where the generic playing pieces 40 are utilized, they may be provided at a central location, such as the location 50 in FIG. 1. Each time one of the subservient players is eliminated one of the generic playing pieces 40 is removed from the board until "and then there were none".

To start the game, all of the pieces 19 may be provided at a generally common location on the board 10 playing surface 11, such as in the "dining room 51" indicia area illustrated in FIG. 1.

While in the preferred embodiment the players may move the pieces 19 to any location on the board 10 that they want to (that is any grid square 12) at any given turn, if desired a random number generator, or some other device which controls the amount of movement of the playing pieces, may be employed, particularly if the number of grid squares 12 is reduced from the ratio to playing pieces illustrated in FIG. 1 (46 to 1) to some much smaller amount (e.g. eight to one). Also the player during his or her turn may, in place of her or his turn or preceding the movement of his or her playing piece (whichever may be desired), either ask the master player to honestly answer a "yes" or "no" question, or provide a clue to the location of a grid square 12 corresponding to a demise location 12' of another subservient player (e.g. higher in the order of succession such as the ninth to die rather than second to die), or that of the master player herself or himself. If a subservient player does move to another subservient player's demise location who is higher up in the order of succession, then the subservient player lower in the order of succession exchanges playing pieces with the player higher in the order of succession. The game may have a rule that once a particular subservient player's demise location is known and one player substitutes at that location, other players cannot do the same thing.

The game may also have any number of other rules in order to enhance the desirability, complexity, speed, or other factors thereof.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims to encompass all equivalent products and methods.

What is claimed is:

1. A game comprising:

a plurality of different, unique, playing pieces;

a board having a playing surface with a grid defined thereon, said grid defining a plurality of grid squares, said plurality of grid squares comprising at least about ten times the number of unique playing pieces;

said playing pieces having a base dimensioned to substantially fit on a grid square;

a map comprising a substantially accurate reproduction of said board playing surface only having dimensions significantly less than said playing surface dimensions;

a plurality of action cards, each action card having a substantially common generic side, and an indicia side having first indicia thereon corresponding to at least one, but not all, of said unique playing pieces, so that at least one of said action cards has indicia thereon corresponding to each of said unique playing pieces; and one or a plurality of information cards or sheets having indicia thereon defining an order of succession for each of said unique playing pieces and relating said action card first indicia to said unique playing pieces.

2. A game as recited in claim 1 further comprising a plurality of character cards, each character card having unique variable second indicia thereon corresponding to one of said unique playing pieces, so a character card with unique second indicia is provided for each of said unique playing pieces.

3. A game as recited in claim 2 wherein said unique playing pieces each having an image of a human being, including unique head features; and wherein said character cards have, as at least part of said second unique variable indicia thereof, said unique head features of the corresponding unique playing piece.

4. A game as recited in claim 3 wherein said one or a plurality of information cards or sheets comprises a plurality of information cards, including one having unique third indicia, including unique succession indicia, for each of said unique playing pieces.

5. A game as recited in claim 4 wherein at least as many action cards are provided as the number of playing pieces.

6. A game as recited in claim 4 wherein each of said information cards includes thereon further indicia corresponding to a plurality, but not all, said action cards.

7. A game as recited in claim 6 wherein said first indicia and said further indicia both comprise a form of demise of at least one of said unique playing pieces, and wherein at least two of said action and information cards have common demise indicia thereon for at least two of said unique playing pieces.

8. A game as recited in claim 1 wherein said number of grid squares is at least about 20 times the number of said unique playing pieces.

9. A game as recited in claim 1 wherein said game is devoid of a generator or selector which dictates or allows movement of said unique playing pieces a predetermined amount.

10. A game as recited in claim 1 wherein said board has pictorial indicia overlying at least some of said grid squares.

11. A game as recited in claim 1 wherein said one or a plurality of information cards or sheets comprises a plurality of information cards, including one having unique third indicia, including unique succession indicia, for each of said unique playing pieces.

12. A game as recited in claim 11 wherein each of said information cards includes thereon further indicia corresponding to a plurality, but not all, of said action cards.

13. A game as recited in claim 12 wherein said first indicia and said further indicia both comprise a form of demise at least one of said unique playing pieces, and wherein at least two of said action and information cards have common demise indicia thereon for at least two of said unique playing pieces.

14. A game as recited in claim 1 further comprising a plurality of generic playing pieces, one corresponding to each of said unique playing pieces.

15. A game as recited in claim 14 wherein said generic playing pieces simulate American Indians; and wherein said plurality of unique game pieces are ten or eleven in number.

16. A method of playing a board game using a board having a playing surface with a grid defined thereon defining a plurality of grid squares greater in number than the number of unique playing pieces; and a plurality of unique playing pieces having a base dimensioned to substantially fit on a grid square, a map comprising a substantially accurate reproduction of the board playing surface only having dimensions less than that of the playing surface dimensions, and a plurality of action cards, comprising:

a) determining which of a plurality of players has which unique playing piece;

b) determining which player will have a master role, with all other players having subservient roles, c) using the map, the player with the master role secretly indicating on the map a unique demise location of each of the subservient role players, as well as the master role player;

d) establishing an order of movement of playing pieces in each of the turns corresponding to a specific order of succession of the unique playing pieces, and the master role player going last;

e) each subservient player moving his or her unique playing piece on the game board grid playing surface during his or her turn to attempt to find a grid square corresponding to the secret map location of another subservient player, or the secret map location of the master role player;

f) the master role player, during his or her turn, moving to the board grid square corresponding to the subservient player first, or next, in the order of succession, and then selecting an action card;

g) if the action card selected in f) corresponds to a predetermined manner of demise of the subservient player effectively removing the respective subservient player's unique playing piece from the game board, and if the action card does not so correspond, the master role player continuing selection of an action card during each of his or her turns until an action card is selected corresponding to the predetermined manner of demise; and h) declaring an end of the game if a subservient player moves his or her playing piece to the grid square on the game board corresponding to the secret demise location of the master player, or when the master player effectively removes all, or all but one, subservient player pieces from the game board pursuant to f) and g) in the proper order of succession.

17. A method as recited in claim 16 wherein a) is practiced by having each player draw a character card, each character card having unique indicia thereon corresponding to a unique playing piece.

18. A game comprising:

a plurality of different, unique, playing pieces;

a board having a playing surface with a plurality of squares, said plurality of playing surface squares greater in number than the number of unique playing pieces;

said playing pieces having a base dimensioned to substantially fit on a playing surface square;

a plurality of action cards, each action card having a substantially common generic side, and an indicia side having first indicia thereon corresponding to at least one, but not all, of said unique playing pieces, so that at least one of said action cards has indicia thereon corresponding to each of said unique playing pieces;

a plurality of character cards, each character card having unique variable second indicia thereon corresponding to one of said unique playing pieces, so a character card with unique second indicia is provided for each of said unique playing pieces; and one or a plurality of information cards having indicia thereon defining an order of succession for each of said unique playing pieces and relating said action card first indicia to said unique playing pieces.

19. A game comprising:

a plurality of different, unique, playing pieces;

a board having a playing surface with a grid defined thereon, said grid defining a plurality of grid squares, said plurality of grid squares greater in number than the number of unique playing pieces;

said playing pieces having a base dimensioned to substantially fit on a grid square;

a plurality of action cards, each action card having a substantially common generic side, and an indicia side having first indicia thereon corresponding to at least one, but not all, of said unique playing pieces, so that at least one of said action cards has indicia thereon corresponding to each of said unique playing pieces;

a plurality of character cards, each character card having unique variable second indicia thereon corresponding to one of said unique playing pieces, so a character card with unique second indicia is provided for each of said unique playing pieces; and one or a plurality of information cards having indicia thereon defining an order of succession for each of said unique playing pieces and relating said action card first indicia A to said unique playing piece.

20. A game as recited in claim 19 wherein said unique playing pieces each having an image of a human being, including unique head features; and wherein said character cards have, as at least part of said second unique variable indicia thereof, said unique head features of the corresponding unique playing piece.

21. A game as recited in claim 20 wherein said character cards have as part of said second unique variable indicia only unique head features of said unique playing pieces.

* * * * *